US012247326B2

(12) United States Patent
McCullough

(10) Patent No.: US 12,247,326 B2
(45) Date of Patent: Mar. 11, 2025

(54) FLEXIBLE IGNITION RESISTANT NON-ELECTRICALLY CONDUCTIVE BIREGIONAL FIBERS, ARTICLES MADE FROM NON-NON-ELECTRICALLY CONDUCTIVE BIREGIONAL FIBERS, AND METHODS OF MANUFACTURE

(71) Applicant: Mariposa Monarca, LLC, Danbury, TX (US)

(72) Inventor: Francis P. McCullough, Angleton, TX (US)

(73) Assignee: Mariposa Monarca, LLC, Danbury, TX (US)

( * ) Notice: Subject to any disclaimer, the term of this patent is extended or adjusted under 35 U.S.C. 154(b) by 368 days.

(21) Appl. No.: 16/549,644

(22) Filed: Aug. 23, 2019

(65) Prior Publication Data

US 2022/0282405 A1 Sep. 8, 2022

Related U.S. Application Data

(60) Provisional application No. 62/722,013, filed on Aug. 23, 2018.

(51) Int. Cl.

*D01F 8/04* (2006.01)
*D01F 8/08* (2006.01)
*D01F 8/18* (2006.01)
*D01F 9/22* (2006.01)

(52) U.S. Cl.

CPC ..... *D01F 8/04* (2013.01); *D01F 8/08* (2013.01); *D01F 8/18* (2013.01); *D01F 9/225* (2013.01); *D10B 2401/041* (2013.01); *D10B 2401/063* (2013.01); *D10B 2401/10* (2013.01); *D10B 2403/02* (2013.01)

(58) Field of Classification Search

CPC ..... D01F 8/04; D01F 8/08; D01F 8/18; D01F 9/225; D10B 2401/041; D10B 2401/063; D10B 2401/10; D10B 2403/02; D02G 3/00; D01D 5/34

USPC ..... 428/368; 423/368, 364, 374, 375, 376, 423/379

See application file for complete search history.

(56) References Cited

U.S. PATENT DOCUMENTS 5,858,530 A * 1/1999 McCullough, Jr. ..... B32B 5/022 423/447.3

* cited by examiner

*Primary Examiner* — Camie S Thompson
(74) *Attorney, Agent, or Firm* — Remenick PLLC

(57) ABSTRACT

A flexible, ignition resistant, non-electrically conductive biregional fiber is disclosed. The biregional fiber comprising an inner core region of a partially oxidized thermoplastic polymeric composition and a surrounding outer sheath region of a thermoset carbonaceous material.

9 Claims, 1 Drawing Sheet

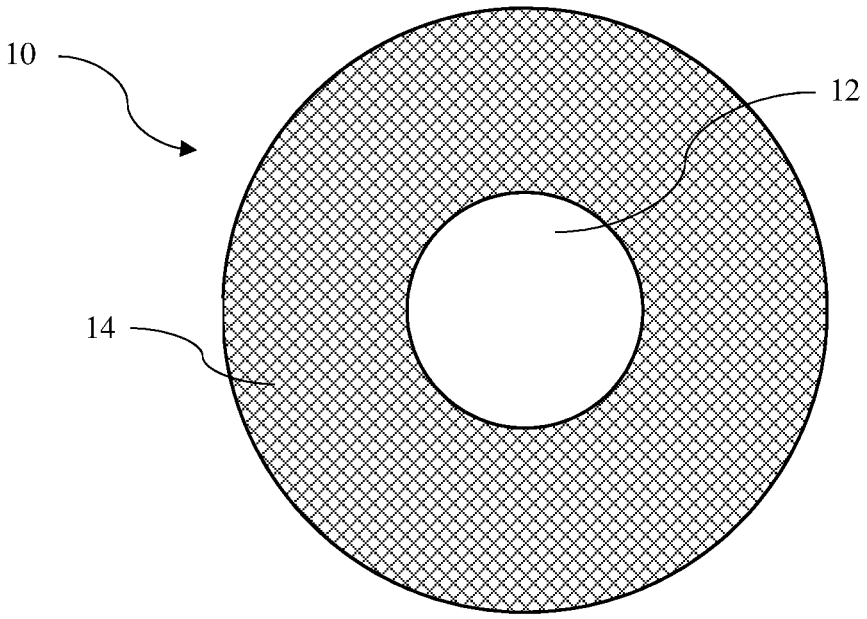
10
12
14

FLEXIBLE IGNITION RESISTANT NON-ELECTRICALLY CONDUCTIVE BIREGIONAL FIBERS, ARTICLES MADE FROM NON-NON-ELECTRICALLY CONDUCTIVE BIREGIONAL FIBERS, AND METHODS OF MANUFACTURE

REFERENCE TO RELATED APPLICATIONS

This application claims priority to U.S. Provisional Application No. 62/722,013 entitled "FLEXIBLE IGNITION RESISTANT NON-ELECTRICALLY CONDUCTIVE BIREGIONAL FIBERS, ARTICLES MADE FROM NON-NON-ELECTRICALLY CONDUCTIVE BIREGIONAL FIBERS, AND METHODS OF MANUFACTURE" filed Aug. 23, 2018, the entirety of which are hereby incorporated by reference.

FIELD OF THE INVENTION

The present invention relates to a flexible, ignition resistant non-electrically conductive biregional fiber derived from a partially oxidized precursor fiber, wherein the ignition resistant, non-electrically conductive biregional fiber has an inner core region of a partially oxidized thermoplastic polymeric composition and a surrounding outer sheath region of a higher density thermoset carbonaceous material. The invention also relates to a non-electrically conductive biregional fiber having an inner core region of a partially oxidized thermoplastic polymeric composition and a surrounding higher density thermoset outer sheath region, a method for the manufacture of the biregional fiber, and articles made from a multiplicity of said biregional fibers.

In both of the biregional precursor fiber and the biregional fiber, the ratio (r:R) of the radius of the core region (r) with respect to the total radius (R) of the biregional fiber is from 1:4 to 1:1.05, preferably from 1:3 to 1:1.12. Preferably, the biregional non-electrically conductive fiber of the invention has a density of from 1.9 g/cm$^3$ to 2.0 g/cm$^3$, and a breaking twist angle of from about 17 to about 23 degrees. The biregional fiber of the invention is ignition resistant and has an LOI (Limiting Oxygen Index) value of greater than 50. The biregional fiber is flexible and lacks the brittleness normally associated with carbon and graphitic fibers of the prior art. The biregional fiber has a breaking twist angle of from 4 to 13 degrees, a bending strain value of from greater than 0.01 to less than 50%, preferably from 0.1 to 30%, and a Young's modulus of less than 1 MM psi (<6.9 GPa).

BACKGROUND OF THE INVENTION

Resilient and flexible, linear and non-linear carbonaceous fibers are now well known in the art. Representative of non-linear carbonaceous fibers is U.S. Pat. No. 4,837,076, issued Jun. 6, 1989 to McCullough et al. The fibers are produced by melt or wet spinning fibers from a thermoplastic polymeric composition and then stabilizing the fibers by treating them in an oxygen containing atmosphere and at an elevated temperature for a predetermined period of time. The oxidation stabilization treatment of the fibers is carried out to the extent such that the entire polymeric composition of the fibers, when viewed in cross-section, is oxidized. Although the stabilization process, to some extent, depends on the diameter of the fibers, the composition of the polymeric precursor composition, the level of oxygen in the atmosphere, and the treatment temperature, the process is extremely time consuming and costly in order to achieve complete stabilization of the fibers throughout their cross section.

Traditionally, the stabilization treatment of polymeric fibers under oxygen extends over at least several hours to in excess of 24 hours to completely permeate the fibers with oxygen and to achieve sufficient stabilization of the fibers in preparation for subsequent carbonization of the stabilized fibers to produce carbonaceous fibers for commercial end uses. The Encyclopedia of Polymer Science and Engineering, Vol. 2, A Wiley-Interscience Publication, 1985, pp. 641-659, reports that "current standard processing technology requires from 1 to 2 hours for adequate stabilization" of fibers, p.658. No other method of processing suitable for large or "heavy" 320 k tows is disclosed. Also, in "High Performance Fibers II", published by Battelle, esp. the chapter entitled "Process Technology-Oxidation/Stabilization", page 149 et seq. it is reported that oxidation and cyclization takes place between 150° C.-300° C. and that "the reaction must take place throughout the fiber and not be confined to the fiber surface." Accordingly, the lengthy stabilization treatment employed in present standard procedures reduces the productive output of stabilized fibers, requires substantial capital investment, and is therefore extremely costly and a major deterrent in rendering the process desirable for greater commercial exploitation, i.e. extended commercial usage of the fibers at lower cost. It is also reported that if electrically heated oxidation chambers are used, the chambers must be substantially larger than the ovens used in a subsequent carbonization step, therefore resulting in a substantially higher capital cost.

It is further taught in U.S. Pat. No. 4,837,076 that the conventionally stabilized fibers (stabilized precursor fibers) are subsequently formed into a coil-like and/or sinusoidal shape by knitting or weaving a fiber tow into a fabric or cloth. The so formed knitted fabric is thereafter heat treated in a relaxed and unstressed condition and in a non-oxidizing atmosphere at a temperature of from 525° C. to 750° C. and for a period of time sufficient to produce a heat induced thermoset reaction wherein additional crosslinking and/or cross chain cyclization occurs between the original polymer chains. The carbonization treatment of the fibers is carried out to the extent such that the entire oxidation stabilized material of the precursor fibers, when viewed in cross-section, is carbonized. Specifically, no residual portion of the oxidation stabilized fiber material remains in a thermoplastic condition. In example 1 of U.S. Pat. No. 4,837,076, it is reported that portions of a stabilized knitted cloth were heat set at temperatures ranging from 550° C. to 950° C. over a 6 hour period. The most flexible fibers and fibers that are subject to the least fiber breakage due to brittleness when subjected to textile processing were obtained in those fibers that had been heat treated at a temperature of from 525° C. to 750° C. The resulting fiber tows, obtained by deknitting the cloth, and having the heat set, i.e. thermoset, non-linear structural configuration, can then be subjected to other methods of treatment known in the art to create an opening, a procedure in which a yam or the fiber tows of the cloth are separated into an entangled, wool-like fluffy material, in which the individual fibers retain their coil-like or sinusoidal configuration, yielding a fluff or batting-like body of considerable loft.

U.S. Pat. No. 4,837,076 also discloses that at a treatment temperature above 1000° C. the stabilized precursor fibers become graphitic and highly electrically conductive to the point where they begin to approach the conductivity of a metallic conductor. These graphitic fibers find special utility in the manufacture of electrodes for energy storage devices. Since graphitization of the stabilized fibers is carried out at a temperature and for a period of time such that the entire stabilized polymeric material of the fiber, when viewed in cross-section, is graphitized, the process, especially at the higher temperatures, is extremely time and energy consuming and equipment intensive, and therefor very costly.

Graphitization of oxidation stabilized fibers is generally desired in order to produce higher tensile modulus properties in the fibers. However, it is reported in High Performance Fibers II, published by Battelle, Copyright 1987, especially the chapter entitled "Process Technology-Graphitization", pages 158 and 159, that "breakage of the fibers is a problem that has not been solved" and that "the most serious disadvantage of these high tensile strength fibers is their low strain-to-failure ratio, which means that they are very brittle". Moreover, the process is also said to be expensive because of the "high capital cost of the equipment and the great amount of electrical energy required to achieve the necessary temperature for graphitization of the fibers (2000° to 3000° C.) throughout their entire cross-section."

Fibers that are generally referred to as "bicomponent or composite fibers", "biconstituent fibers", "bilateral fibers" and "sheath-core fibers" are commonly known in the art. Definitions of these terms can be found in "Man-Made Fiber and Textile Dictionary", Hoechst Celanese Corporation, 1990, pp. 14, 15, 32, and 139. A bicomponent or composite fiber is defined as a fiber composed of two or more polymer types in a sheath-core or side by side (bilateral) relationship. Biconstituent fibers are defined as fibers that are extruded from a homogeneous mixture of two different polymers wherein such fibers combine the characteristics of the two polymers into a single fiber. Bilateral fibers are two generic fibers or variants of the same generic fiber extruded in a side by relationship. Sheath-core fibers are bicomponent fibers of either two polymer types or two variants of the same polymer. One polymer forms a core and the other polymer of a different composition surrounds it as a sheath.

Bicomponent fibers have also been generally disclosed in U.S. Pat. No. 4,643,931, issued Feb. 17, 1987 to F. P. McCullough et al. These fibers are blends of a small amount of conductive fibers into a yarn to act as an electrostatic dissipation element. Fiber manufacturers also routinely manufacture conductive fibers by incorporating into a hollow fiber a core of carbon or graphite containing thermoplastic composite or by coating a fiber with a sheath made of a thermoplastic composite containing carbon or graphite.

A similar electrical storage device is disclosed in U.S. Pat. No. 4,830,938 to F. P. McCullough et al., issued May 16, 1989. This patent discloses a shared bipolar, carbonaceous fibrous, electrode which is capable of carrying a current from one cell to an adjacent cell without a current collector frame associated therewith. Neither of the aforementioned McCullough et al. patents disclose the use of ignition resistant biregional fibers having an inner core region of a thermoplastic polymeric composition and a surrounding outer sheath region of a thermoset carbonaceous material.

DEFINITIONS

The terms "biregional fiber", "ignition resistant non-electrically conductive biregional fiber", "BFR" and " NECBRF" are interchangeably used herein and generally refer to a fiber that is preferably produced from a partially oxidized acrylic fiber.

The term "homogeneous" when applied to a homogeneous polymeric composition, refers to a composition which is uniformly the same i.e. made up of a single polymeric composition having a single coefficient of crystallinity and melting point.

Oxidation and cyclization of the polymeric fiber generally takes place at a temperature of between 290° C. to 320° C. and for a length of time sufficient (preferably less than 5 minutes) to produce an outer sheath of ignition resistant non-electrically conductive stabilized thermoplastic polymeric material of any desired thickness. It will be understood, that stabilization of a polymeric composition can be accomplished by means other than "oxidation" as, for example, by chemical oxidants applied at lower temperatures.

The terms "ignition resistant" or "non-flammable" used herein generally refers to the property of a specimen which will not sustain combustion in air when subjected to an ignition source (a flame source) at a temperature of 1000° C. or greater. Ignition resistance is determined by a LOI test which is also known as the "oxygen index" or "limited oxygen index" (LOI) test. With this procedure the concentration of oxygen in $O_2/N_2$ mixtures is determined at which a vertically mounted specimen, when ignited at its upper end, just continues to burn. The size of the specimen is 0.65-0.3 cm wide and has a length from 7 to 15 cm. The LOI value is calculated according to the equation:

$$LOI = \frac{[O_2]}{[O_2 + N_2]} \times 100$$

The term "thermoset" used herein applies to polymeric compositions that have undergone a heat induced cross linking reaction of the molecular constituents to irreversibly "set" the polymer. A thermoset polymer has essentially no tendency to melt or soften under carbonization conditions and will not exhibit any breakage of the outer carbonized region of the fiber, for example, when the fiber is subjected to a twist angle of greater than 5 degrees (as defined herein). The breaking twist angle varies, of course, and is dependent on the degree of carbonization, i.e. carbon content of the outer carbonized sheath, and the depth of carbonization into the fiber. The breaking twist angles for different types of biregional fibers of the invention are set forth in Table II.

The term "bending strain" as used herein is as defined in Physical Properties of Textile Fibers by W. E. Morton and J. W. S. Hearle. The Textile Institute, Manchester, England (1975), pages 407-409. The percent bending strain on a fiber can be determined by the equation $S=(r/R)\times 100$ where S is the percent bending strain, r is the effective cross sectional fiber radius and R is the radius of curvature of the bend. That is, if the neutral plane remains in the center of the fiber, the maximum percentage tensile strain, which will be positive on the outside and negative on the inside of the bend, equals $(r/R)\times 100$ in a circular cross section of the fiber.

The term "flexible" used herein is specifically applicable to fibers of the invention having a bending strain value of from greater than 0.01 to less than 50%, preferably from 0.1 to 30%.

The term "Breaking twist angle, a" as used herein is as defined in Physical Properties of Textile Fibers by W. E. Morton and J. W. S. Hearle. The Textile Institute, Manchester, England (1975), pages 421-425. If a fiber is twisted far enough, it will eventually break. The breaking point at which this occurs is called the "breaking twist" The number of turns until rupture is inversely proportional to the fiber diameter. To obtain a characteristic property of the fiber material, one may use the breaking-twist angle, a. This is the angle through which the outer layer can be twisted until it is sheared and is given by the formula:

$$\tan \alpha = \pi d \tau b$$

where d=diameter of the fiber and τb=breaking twist in turns per unit length.

The term "shear sensitivity" used herein generally applies to the tendency of a fiber to become fractured along a plane in the cross section of a fiber as a result of forces such as those caused by twisting. In practical terms, when fibers are subjected to certain textile operations such as the drafting operation in a yarn blending process, the drafting rollers exert significant shear on the fibers being drafted. Shear sensitive fibers exhibit extensive damage, if not complete breakage, whereas shear resistant fibers do not exhibit any significant breakage in this process step.

Conversely, the term "shear resistant" is applied to fibers which do not tend to break significantly when exposed to textile process operations such as drafting or twisting which exert significant shear stresses on the fibers being processed.

The term "bulk resistivity" used herein generally applies to the effective resistivity of an ignition resistant biregional fiber taking into account the specific resistivity of the composition of each region and the proportion of area represented by each region, i.e., the particular ratio (r:R) as it applies to a fiber with predetermined selected properties.

The term "polymeric composition" used herein include those polymeric materials as defined in Hawley's Condensed Chemical Dictionary, Eleventh Edition, page 938.

The term "crimp" as used herein applies to the waviness or nonlinearity of a fiber or fiber tow, as defined in "Man Made Fiber and Textile Dictionary" by Celanese Corporation.

The term "Fiber Assembly" used herein applies to a multiplicity of fibers of the invention that are in the form of a yarn, a wool like fluff, a batting, mat, web or felt, a blend of the with other natural or polymeric fibers, a compression formed sheet, screen or panel of the fibers, generally with a small percentage of less than 10% of a binder especially binder fibers, a knitted or woven cloth or fabric, or the like.

The term "Cohesion" or "Cohesiveness" used herein, applies to the force which holds fibers together, especially during yarn manufacture. It is a function of the type and amount of lubricant used and the fiber crimp.

The term "aspect ratio" is defined herein as the length to diameter (lid) ratio of a fiber.

All percentages given herein are in "percent by weights" unless otherwise specified.

SUMMARY OF THE INVENTION

The present invention comprises a major departure from the present state of the art in that it is now no longer necessary to completely oxidatively stabilize polymeric fibers throughout their cross section, but that such fibers can now be made into biregional ignition resistant non-electrically conductive fibers by limiting the extent of stabilization to an outer region of the fibers such that the length of time that is required to effectively stabilize the fibers is substantially reduced, resulting in a substantial reduction in the cost of manufacture. By "effectively stabilized" is meant that the fiber has the characteristics of a fully stabilized fiber and can be exposed to the higher temperatures and the high density of the sheath (1.9-2.0 g/cc) makes a effective block to radiant energy transfer without having electrical conductivity of graphite carbon structures of similar densities and the elongation of a textile material (>18%) compared to electrically conductive carbons and graphite fibers having an elongation of <10%.

It is therefore a particular object of the invention to provide a flexible ignition resistant non-electrically conductive fiber which provides an effective block against radiant energy transfer preferably derived from a precursor fiber, with said biregional fiber ("BRF") having an inner region of a thermoplastic partially oxidation stabilized acrylic polymeric core and a surrounding outer region of a thermoset ignition resistant non-electrically conductive sheath.

It is another object of the invention to provide a process for the manufacture of an ignition resistant non-electrically conductive biregional fiber which provides an effective block against radiant energy transfer by treating a fiber preferably made from a partially oxidized acrylic fiber in an oxidizing atmosphere for a period of time and at a temperature sufficient to convert the outer sheath to an ignition resistant non-electrically conductive sheath which provides an effective block against radiant energy transfer It is a further object of the invention to provide various assemblies from a multiplicity of the novel fibers of the invention, i.e. BRF, or mixtures thereof, said assemblies including tows, non-woven assemblies such as, for example, a wool like fluff, a batting, web, felt, and the like, blends of the biregional fibers with other natural or polymeric fibers, a compression formed or densified sheet or panel of the biregional fibers, usually containing a small percentage of less than 10% of a polymeric binder, especially binder fibers, or knitted or woven fabric, and the like. In any of these assemblies or structures, the BRF can be linear or crimped, or a mixture thereof.

It is also an object of the invention to provide a multiplicity of crimped biregional fibers of the invention in the form of a wool like fluff or batting with substantial loft for use as a flame resistant thermal insulation for buildings, such as residential, office, or public buildings, etc. Although these thermal insulation fibers are preferably biregional fibers, they can also be a mixture of the BRF and other fibers. Depending on the degree of carbonization of the sheath of the BRFs, i.e. electrically non-conductive, semi-conductive, or conductive, the fibers can also be used for various other purposes such as an antistat or electromagnetic shielding material; as a flame resistant thermal insulation and sound absorbing material in aircraft, or as a fire blocking panel in vehicles such as automobiles, aircraft, ships, etc.

It is another object of the present invention to blend the fibers of the invention with other natural or polymeric fibers. These fibers are particularly useful in the preparation of yarn for the manufacture of textiles. Linear, or non linear or crimped BRFs, when blended with other natural or synthetic fibers, are useful in the form of a wool like fluff that can be used in clothing articles such as, for example, jackets, blankets or sleeping bags.

In another object of the invention, the BRFs can be employed as a reinforcement material in a polymeric matrix, forming a fiber reinforced composite. The fibers can be linear, non-linear, or a mixture of the linear and non-linear fibers and can be applied to at least one surface of the polymeric matrix or dispersed throughout the polymeric matrix. When the BRFs are applied to the surface of a polymeric panel such as, for example, a panel formed from a polystyrene polymer, as little as about 10% by weight of the fibers, based on the total weight of the panel, provide the panel with fire resistance. When the BRFs are distributed throughout the polymeric panel, in an amount of up to 95% by weight, the fibers provide a composite having improved fire resistance, as well as vibration and impact resistance and adhesion.

It is a further aspect of the invention, to provide the biregional fiber of the invention with a conformal silicone coating in order to enhance the fire resistant characteristics of the fiber.

It is also an aspect of the invention, to provide an assembly from a multiplicity of the biregional fibers of the invention and to coat the assembly with a hydrophobic material coating in order to render the assembly buoyant.

It is a further object of the invention to employ a multiplicity of the biregional fibers of the invention in the form of a batting, webbing, or the like, as an electromagnetic shielding material. Optionally, the shielding material can be incorporated into a polymeric matrix to form a panel.

Further objects of the invention, not specifically recited herein above, will become apparent from a reading of the detailed description of the invention.

In general, the biregional fibers of the invention distinguish over the various types of fibers of the prior art in that the biregional fiber is preferably produced from a partially oxidized non-electrically conductive polymeric composition. When the ignition resistant non-electrically conductive biregional fiber of the invention is manufactured from a partially oxidized acrylic polymer, there is no boundary or discontinuity between the inner core and the outer oxidation stabilized non-electrically conductive sheath.

In the case of a core/sheath fiber, the outer sheath layer is formed much like a skin layer and is separate and distinct from the inner core thus forming a physical boundary or discontinuity between the inner core and the outer skin layer. More specifically, in viewing a cross sectional surface of a bilayered or sheath-core fiber (generally coextruded), inspection of the surface from an outer periphery to the center of the fiber surface, one would pass from one type of polymeric composition forming the outer sheath layer through a boundary layer or discontinuity into the core having another polymeric composition of different crystallinity. As previously indicated, polymers having different compositions also have different coefficients of crystallinity and melting points. For example, polyacrylonitrile will undergo a melting point transition at a temperature range of 320° C.-330° C. This represents a relatively high melting point for polymers and is characteristic of stiff chains. Both nylon 6,6 and PET fibers melt at 265° C., and polyolefins such as polyethylene and polypropylene melt around 135° C. and 165° C., respectively. Accordingly, although the inner core and the outer sheath of the biregional fiber of the invention forms two visually distinct regions, when viewed in cross section, they do not form a physical boundary or discontinuity between the core and the sheath, i.e. the regions are continuous.

BRIEF DESCRIPTION OF THE DRAWINGS

FIG. 1 is a generally circular in cross section, ignition resistant biregional fiber of the invention.

DETAILED DESCRIPTION OF THE INVENTION

In the manufacture of carbonaceous fibers, stabilization of polymeric fibers is generally conducted in an oxidizing atmosphere and under tension at a moderately elevated temperature of, typically, from 150° C. up to 350° C. for PAN (polyacrylonitrile) fibers and for a period of time sufficient to achieve complete permeation of oxygen throughout the fiber, and then heat treating the "Oxidized PAN Fiber" (OPF) in a non-oxidizing atmosphere, usually under tension, at a temperature above 750° C. to produce a fiber that is carbonized throughout a cross section of the fiber, i.e. throughout the fiber material. Fibers that are treated at a temperature above 1500° C. typically have a carbon content of greater than 92% and are characterized as carbon or graphitic fibers having a high tensile strength. Stabilization of the fibers involves (1) an oxidation cross-linking reaction of adjoining molecular chains as well as (2) a cyclization reaction of pendant nitrate groups to a condensed heterocyclic structure. The reaction mechanism is complex and not readily explainable. It is believed, however, that these two reactions occur concurrently and may be competing. The cyclization reaction is exothermic in nature and must be controlled if the fibrous nature of the acrylic polymer undergoing stabilization is to be preserved.

Because the reactions are highly exothermic in nature, the total amount of heat released is so great that temperature control is difficult. Care must be taken to avoid processing too large a number of fibers in close proximity, which would cause localized heat buildup and impede heat transfer to the atmosphere around the fibers in the fiber assembly (e.g. a fiber tow or a woven or knitted cloth). In fact, the oxidation stabilization of acrylic fibers has a considerable potential for a runaway reaction. Furthermore, some trace of hydrogen cyanide is evolved during this step and the content of this component in the atmosphere of the oven must be prevented from getting into the explosive range by injecting nitrogen, as required. Accordingly, prior art techniques overcome this problem by heating the fibers at a moderate temperature and at a controlled oxygen content over many hours. Control of the oxygen containing atmosphere, e.g. air, can be achieved by diluting the air with nitrogen.

Since thermal stabilization has tended to be unduly time consuming and capital intensive, various other approaches have also been proposed to expedite the desired reaction, e.g., through the use of stabilization promoting agents and/or chemical modification of the acrylic fiber before it can be pyrolized. However, these approaches have also added to the cost of manufacture and further lengthened the time of processing the fibers.

It has surprisingly been discovered that the extent of oxidation stabilization of a polymeric fiber such as, for example, an acrylic fiber can be substantially reduced by oxidizing only an outer portion or region (when viewed in cross section) of the fiber while the inner portion or core of the fiber remains in a thermoplastic and non-stabilized condition. Achieving stabilization of only an outer region of a fiber can therefore be conducted over a much shorter period of time, depending on the desired thickness of the stabilized outer fiber sheath. Typically, the ratio of the radius of the core with respect to the total radius of the fiber is from 1:4 to 1:1.05, preferably from 1:3 to 1:1.12. At a ratio of 1:4, it can be calculated that the percentage volume that is represented by the core is about 6% by volume, leaving about 94% for the outer sheath. At a ratio of 1:1.05 the percentage volume that is represented by the core is about 91%, leaving about 9% for the outer sheath. It is generally preferred to keep the ratio at a value where the volume of the outer sheath is relatively small, preferably less than 25%, which represents a ratio of 1:1.12 to less than 1:1.15 in order to keep the time of oxidation or carbonization treatment at a minimum without detrimentally affecting the intended commercial performance of the fiber.

It will be understood that the ratio can be adjusted to any value, depending upon the end use or physical characteristics desired for the biregional fiber of the invention. For example, a ratio of from 1:1.12 to 1:1.16 would be satisfactory for use of a multiplicity of the biregional fibers as thermal insulation for building structures.

The following Table demonstrates the typical physical characteristics for various types of fibers including the fibers of the invention:

TABLE 1

| | Conductive Fiber | Precursor Fiber | Inventive Fiber |
|---|---|---|---|
| Electrically conductivity | very high | non-conductive | non-conductive |
| Core makeup | acrylic | acrylic | partially ox acrylic |
| Core color | off white | off white | dark grey to black |
| Core removable under high temp | yes | yes | no |
| core density | 1.22 | 1.22 | 1.3 |
| sheath density | 1.6 to 1.8 | 1.60-1.65 | 1.9-2.0 |
| sheath structure | laminar | tetrahedral | tetrahedral |
| sheath hardness | low | medium | high |
| radiant blocking | low | medium | high |
| carbon content of sheath | 92-99 | <88 | <88 |
| Fiber made from | Precursor Fiber | acrylic | oxidized acrylic |

The conductive fiber and precursor fibers are disclosed in U.S. Pat. No. 5,858,530 to McCullough, herein incorporated in its entirety. The precursor fiber was a biregional fiber comprising an acrylic core and a carbonaceous sheath where the core had a density of 1.22 and the sheath at a density of approximately 1.61 to 1.65 grams per cc. The sheath of the precursor fiber had a higher density than a normal oxidized acrylic fiber which has a density of 1.36 to 1.40 g per cc. This higher density gave the precursor fiber some radiant blocking characteristics for thermal insulation where the ΔT was approximately 50° F. and the radiant contribution of the loss was approximately 40%. As the density increases to flame temperatures, such as encountered in the Pyroman test, or the ΔT approaches 2300° F. almost all heat transfer is radiant. Preferably, the fibers of the instant invention, which have a much higher density sheath, have a significantly higher gradient blocking ability than the precursor fiber when protecting against flame with a 2300° F. ΔT.

Preferably, the fibers of the instant invention have a partially oxidized acrylic core with a density of 1.30 and a sheath with a density of 1.9 to 2.0, which is the density of a high carbon graphite without the laminar structure. With the existing carbon graphite fibers, there is a laminar structure which is very electrically conductive, whereas the sheath of the fibers of the instant invention have a three-dimensional structure similar to the structure of diamonds and the fibers are totally electrically nonconductive. The high density sheath preferably will block essentially 100% of the radiant energy transfer of a flame where the ΔT is 2300° F.

Partially oxidized polymeric materials that can be suitably used herein to make the fibers of the invention include any of the well known partially oxidized polymers that are capable of being stabilized and carbonized to form the fibers. Exemplifications of such polymeric materials are copolymers and terpolymers of polyacetylene, polyphenylene, and polyvinylidene chloride. Other well known polymeric materials include aromatic polyamides (Kevlar™), polybenzimide resin, Saran™, and the like. Mesophase pitch (petroleum or coal tar) containing particulate impurities or additives can also suitably be employed. Preferably, the polymeric composition for the manufacture of the fibers of the invention is a partially oxidized acrylic or a sub-acrylic polymer (as hereinafter defined).

It is known in the art and an accepted standard, imposed by the Federal Trade Commission, that the term "acrylic" applies to any long chain synthetic polymers composed of at least 85 mole percent by weight of acrylonitrile units and less than 15 mole percent of another polymer. Fibers made from these acrylic compositions are usually wet spun and are limited to fibers having a circular cross-section. Partially oxidized acrylic polymers which are the materials of choice in preparing the fibers of the invention are selected from one or more of the following: acrylonitrile based homopolymers, acrylonitrile based copolymers and acrylonitrile based terpolymers. The copolymers typically contain at least about 85 mole percent of acrylonitrile units and up to 15 mole percent of one or more monovinyl units that are copolymerizable with acrylonitrile including, for example, methacrylic acid esters and acrylic acid esters such as methyl methacrylate, ethyl methacrylate, propyl methacrylate, butyl methacrylate, methyl acrylate and ethyl acrylate; vinyl esters such as vinyl acetate and vinyl propionate; acrylic acid, methacrylic acid, maleic acid, itaconic acid and the salts thereof; vinylsulfonic acid and the salts thereof.

The physical shape of the partially oxidized polymeric fiber that can be suitably employed in the production of the oxidation stabilized or carbonized ignition resistant biregional fibers of the invention can be of the usual generally circular in cross section fiber, having an aspect ratio of greater than 100:1.

Preferably, the fibers of the invention have a non-circular cross sectional shape as described in Modern Textiles, second edition, 1982, by D. S. Lyle, John Wiley & Sons. In the chapter entitled "Fiber Properties", pp. 41 to 63, various natural and polymeric fibers are described having different surface contours, i.e. smooth, rough, serrated, etc. which are said to influence cohesiveness, resiliency, loft, and thickness. Polymeric fibers having various non-circular cross-sectional shapes are described in Table 2-9 on pages 52 and 53 and include tubular, triangular, irregular, striated, oval, etc. Reference to non-circular in cross section fibers and their use in electrodes is also made to copending U.S. patent application Ser. No. 081372,446, filed Jan. 13, 1995 in the name of Francis P. McCullough. The non-circular in cross section fibers of the invention preferably are multi-lobal, e.g. trilobal or pentalobal, in cross-section.

The fibers of the invention can be made more easily and at a substantially lower manufacturing cost from an unfiltered polymeric composition such as, for example, an acrylic or sub-acrylic polymer that can contain from 0.0001 to 5% by weight particulate matter in which the individual particles have a diameter of less than 0.1 microns, preferably less than 0.001 microns. Sub-micron particles are naturally present in any polymeric composition and thus will also be present in polymeric compositions that are extruded to form fibers for use in the manufacture of textile articles, for example. These particles are generally organic or inorganic materials which are insoluble in the polymeric melt or dope. The term "unfiltered" used herein applies to polymeric compositions which, when in a melt phase and during manufacture, are not subjected to the usual micro-filtration procedure to remove impurities, such as non-polymeric inclusions, from the polymeric compositions.

It is also contemplated and within the scope of the invention to introduce an additional quantity of sub-micron particulate matter, such as, for example, fumed silica, calcium oxide and various other inorganic materials such as silicates into the polymeric composition. It has been found that the addition of from 0.01 to 2%, preferably from 0.1 to 1% of these sub-micron particles into the polymeric composition will reduce the formation of a high degree of order or crystallinity in the polymeric composition of the spun fiber. When the fiber is subsequently heated and carbonized in a non-oxidizing atmosphere, it lacks the stiffness, brittleness and high modulus that is normally associated with traditional carbon or graphitic fibers, while still exhibiting a low electrical resistivity and good uniform and contiguous surface structure, free from the voids, pores and pitting normally associated with adsorptive carbon materials.

The fibers of the invention are essentially continuous, i.e. they can be made to any desired length, they can be essentially linear or nonlinear (i.e. nonlinear being crimped in a conventional manner in an air jet, stuffer box or gear crimping mechanism), and possess a high degree of flexibility which manifests itself in a fiber which has a much greater ability to withstand shear, which is not brittle, and which has a bending strain value of from greater than 0.01 to less than 50%, preferably from 0.1 to 30%. These properties allow the fibers of the invention to be formed into a variety of assemblies or configurations for use in many different types of applications, such as battings, webs, etc. In contrast, the bending strain value of a conventional carbon or graphitic fiber, for example, with a high modulus is substantially less than 0.01% and often less than 0.001%. Moreover, the non-circular cross-sectional shape of a multiplicity of non-linear fibers of the invention is particularly advantageous, e.g. especially in battings, since they are capable of forming a highly intertwined fibrous structure having a higher thermal R value at a given density compared to a batting containing fibers having a substantially round cross sectional shape. This is due mainly to surface interactions between the fibers and some enhanced Knudsen effects. In blended yarns, the non-circular cross section of the fibers of the invention also exhibit greater flexibility and deflective recovery without breakage as compared to a conventional round cross-sectional fiber, principally due to the smaller apparent diameter of the non-circular shape of the fiber. Although the fibers of the invention can have a diameter of as large as 30 microns, it is preferred to form the fibers of a relatively small diameter of from 2 to 15 microns, preferably from 4 to 8 microns, since the diameter of the fiber is generally proportional to its surface area. Specifically, two fibers of a generally round or circular cross section and having a diameter of 5 microns will present about 4 times the surface area of a single fiber having a diameter of 10 microns.

With particular reference to FIG. 1, there is illustrated a non-electrically conductive ignition resistant biregional fiber of the invention having a generally circular cross-sectional shape. The fiber is generally identified by reference number 10 and comprises an inner core region 12 of a partially oxidized thermoplastic polymer and a surrounding outer region of a thermoplastic stabilized sheath or a thermoset carbonaceous sheath 14. The fiber has a nominal cross-sectional diameter, when bisected, which is the linear distance from any one point along the outer surface of the fiber through the center of the fiber to an opposite point on its outer surface. Accordingly, the nominal diameter of a circular fiber is also its "effective" diameter.

In a preferred embodiment, the outer sheath 14 is a thermoset carbonaceous material having a $Sp^3$ or tetrahedral structure similar to the structure of a diamond. Outer sheath 14 may be comprised of carbon or may have nitrogen and/or oxygen components. Preferably outer sheath 14 is non-conductive and has a density of 1.9-2.0 g per cc. Preferably, inner core region 12 is a non-melting or non-vaporizing partially oxidized acrylic. Preferably, inner core region 12 has a density of 1.3 g per cc. Preferably, the structure and density of fiber 10 provides radiant blocking and/or fire blocking. For example, a fabric made from fibers 10 may provide 5-30 second of protection in a flash fire.

Optionally, the fibers of the invention can also be in the shape of a hollow or generally tubular fiber or can be provided with one or more central passageways extending along the length of the fiber core. These types of fibers represent a saving in the amount of polymeric composition used without any sacrifice in performance. Additionally, the interior passageway(s) renders the fiber even more flexible. It will be understood that a tubular cross section fiber would present concentric regions of a thermoset or carbonaceous outer region and a thermoplastic inner ring core.

Preferably, the biregional fiber of the invention should have the following physical property criteria:

(1) A ratio (r:R) of the radius of the core region (r) with respect to the total radius of the fiber (R) of from 1:4 to 1:1.05, preferably from 1:3 to 1:1.12. The ratio of core volume to total volume of the fiber has a substantial effect on the performance properties. Therefore, if ignition resistance is desired, then a ratio (r:R) of from 1:1.05 to 1:1.2 gives acceptable performance, whereas for fireblocking performance a ratio of 1:1.12 to 1:1.4 is desirable.

(2) A density of from 1.90 to 2.0 g/cm$^3$. It should be understood, however, that the density of the fiber is dependent upon the ratio (r:R) of the radius of the core (r) with respect to the diameter of the fiber (R).

(3) A Young's modulus of less than 1 MM psi (<6.9 GPa).

(4) An aspect of greater than 100:1 (the aspect ratio is defined herein as the length to diameter 1/d ratio of the fiber), and a fiber diameter of from 1 to 30 microns (micrometers), preferably from 1 to 15 microns, and more preferably from 4 to 12 microns.

(5) A surface area of around 1 m$^2$/g. It will be understood that the carbonaceous surface area of the fiber can be as low as 0.1 m$^2$/g, but that such a low surface area will not provide the optimum in terms of the storage capacity or coulometric efficiency where the fiber is used as an electrode for a secondary storage device.

(6) The carbonatious outer sheath should have a carbon content of typically less than 88% by weight. The carbon content of the outer fiber sheath is somewhat dependent on the type of partially oxidized thermoplastic that is used.

(7) The fiber is preferably non-electrically conductive.

(8) A bending strain value of from greater than 0.01% to less than 50%, preferably from 0.1 to less than 30%.

(9) A breaking twist angle of from 17 to 23 degrees.

(10) A fiber is crimped and has an elongatability to break of from 15 to 25%

The partially oxidized polymeric fiber is oxidatively stabilized in a stabilization chamber at a temperature of from 290° to 320° C. in an oxidizing atmosphere. The time of oxidation for the fibers of the invention is, however, substantially reduced to less than 1 hour, preferably less than 30 min, more preferably less than 5 minutes.

Ignition resistant non-electrically conductive biregional fibers can be converted into a wool like fluff or batting, for example, having high thermal insulation R values. These fibers can be employed as insulation for building structures, as stuffing for jackets or sleeping bags.

The fibers can be made into various different assemblies such as blends in which the fibers are blended with other natural or polymeric fibers to form ignition resistant and fire retarding assemblies; composites in which the fibers are incorporated into a polymeric matrix to render the composites flame retarding and to increase the strength of the composite. The fibers, when compression formed with a binding agent, are particularly suitable for use as a fire blocking sheet or panel. The fibers or assemblies can also be provided with various coatings, including an organosilcone polymer that renders the fibers or assembly synergistically substantially more fire retarding, or a hydrophobic coating to render the assembly buoyant and or to reduce the water pickup.

Preferred fibrous assemblies consisting of a multiplicity of the fibers of the invention can be in the form of randomly entangled fibers in the form of a wool-like fluff, a generally planar non-woven sheet, web or batting, a compression formed panel, a woven or knitted fabric, or the like. Exemplary of a preferred fibrous assembly is a generally planar sheet like article, such as a batting, made from a multiplicity of individual, non-linear (i.e. crimped) fibers of the invention. In a preferred method of fabrication of a batting a heavy tow of 320,000 (320K) polymeric fibers are employed. In the case of tows containing a smaller number of fibers, e.g. up to 40,000 fibers, the smaller tows can be fabricated into a knitted or woven cloth-like product. It is preferred to form the polymeric fibers, preferably in a stabilized condition, into the desired form (knit, woven, sheet or felt) prior to carbonization.

The present invention further contemplates the manufacture of fire retarding and fire blocking assemblies in a manner similar to the general procedures described in U.S. Pat. No. 4,879,168, issued Nov. 7, 1989 to F. P. McCullough et al. Various terms such as "fire resistant" used herein relate to any one of the characteristics of flame arresting, flame retarding, fire shielding and fire barrier.

An article is considered to be flame retarding to the extent that once an igniting flame has ceased to contact unburned parts of a textile article, the article has the inherent ability to resist further propagation of the flame along its unburned portion, thereby stopping the internal burning process. Recognized tests to determine whether a textile article is flame retarding are, inter alia, the American Association of Textile Chemists and Colorists Test Method 34-1966 and the National Bureau of Standards Test described in DOC FF 3-71.

An article is considered to be "fire shielding" if it is capable of deflecting flames and the radiation therefrom in a similar manner as aluminum coated protective garments, which are known in the art.

Fire barriers have the capability of being non-flammable, flame retarding and providing thermal insulation characteristics.

In accordance with the general teachings of U.S. Pat. No. 4,879,168, at least 7.5% by weight of a multiplicity of non-linear, resilient, shape reforming, fiber can be blended with natural or synthetic fibers to form a fire retarding blend. The resilient and shape reforming characteristics of the fiber is, to some extent, dependent on the degree of carbonization and the ratio (r:R). For example, where the ratio indicates that the carbonaceous sheath represents a major portion of the fiber and that the degree of carbonization indicates that the outer sheath is graphitic and has a density of greater than 1.85 g/cm$^3$ and a bulk resistivity of less than $10^{-2}$ ohm-cm, the resiliency of the fiber is, relatively speaking, smaller than a fiber in which the carbonaceous outer sheath represents a minor portion or ratio (r:R) of the fiber and the degree of carbonization is low, i.e. where the outer sheath is electrically non-conductive.

The natural fibers can be selected from, for example, cotton, wool, flax, silk, or mixtures of one or more thereof with the fiber of the invention. The polymeric fibers can be selected from, for example, cellulose, polyester, polyolefin, aramid, acrylic, fluoroplastic, polyvinyl alcohol and glass, or mixtures of one or more thereof with the ignition resistant biregional fibers of the invention. Preferably, the fiber are present in the blend in an amount of from 10% to 40%, are electrically non-conductive, antistatic or conductive, have a specific resistivity of from $10^8$ to less than 10° ohm-cm, a density of from 1.45 to 1.85 g/cm$^3$, and an elongatability of from 15%to 25%. These fibers are not shear sensitive or, at most, are slightly shear sensitive, in comparison to fully carbonized fibers having a similar specific resistivity and which are shear sensitive. Greater amounts of the fiber in the blends improves the fire blocking and fire shielding characteristics of the blend. However, it is desirable to maintain a fiber characteristic close to the conventional blends so as to have a desirable aesthetic appearance and feel.

The present invention further contemplates the manufacture of fire retarding and fire shielding assemblies in a manner similar to the general procedures described in U.S. Pat. No. 4,980,233, issued Dec. 5, 1990 and U.S. Pat. No. 4,997,716, issued Mar. 5, 1991, both to F. P. McCullough et al. According to such procedure for example, a panel or sheet formed from a polystyrene polymer, or a panel comprising a compression formed composite of a thermoplastic or thermosetting polymer and incorporating from 10% to 95% by weight, based on the total weight of the composite, of a multiplicity of non-linear, resilient, shape reforming fiber can be provided. The fibers can be concentrated on the surface of the panel in an amount of 10% or greater, or they can be distributed throughout the polymeric matrix in an amount of from preferably 20% to 75%. Optionally, the fibers can be applied to the surface as well as throughout the polymeric matrix. Flammability tests for the structure are conducted according to the Ohio State Burn Test and must meet the standard which is set forth in FAR 25.853.

The present invention further resides in a means for synergistically improving the resistance to oxidation and thermal stability of the fiber in accordance with the general procedures described in U.S. Pat. No. 5,024,877, issued Jun. 18, 1991 to F. P. McCullough et al. According to such procedure the fibers are blended with from 0.5 to 90% by weight of an organosilicone polymer derived from the hydrolyzed partial condensation product of a compound selected from the group consisting of $R_xSi(OR')_{4-x}$ and $R_xSi(OOR')_{4-x}$, wherein R is an organic radical and R' is a lower alkyl or phenyl radical, and x is at least 1 and less than 4. Preferably, the organosilicone polymer is selected from the group consisting of trimethoxymethylsilane and trimethoxyphenylsilane. BRF, when coated with as little as 0.5% of the organosilicone polymer exhibit substantially improved fire retardancy. Composites in which the organosilicone polymer is present in an amount of as much as 90% by weight of the composite are useful in applications such as gaskets, for example.

In accordance with one embodiment, the invention is directed to a composite which comprises a synthetic resin, such as a thermoplastic or thermosetting resin, that is compressed together with a batting of the fiber. Prior to compression, the batting is treated with an organosilicone polymer in an amount to provide enhanced ignition resistance. Generally, there is utilized up to about 20%, preferably about 10% by weight of a polymerizable silicone resin. Such a composite will be useful, particularly in forming fire resistant or flame shielding structural panels, for use in vehicles and installations, particularly airplanes.

In another embodiment, from 10 to 90%, preferably from 20 to 75% by weight of the fiber can be used in combination with a synthetic resin in fabricating a composite. The synthetic resin used in the composites can be selected from any of the conventional type polymeric materials such as thermoplastic or thermosetting polymers. Composites with a higher loading of the BRF are particularly useful in forming fire blocking structural panels, for use in vehicles and installations, particularly ships and airplanes.

Many composites and structures are possible and when prepared for a specific application will depend on the mechanical properties desired by the end-user. Generally, it has been found that the fiber loadings of from 10 to 75% by weight are preferable for preparing flexible panels, in combination with the binder resins and/or organosilicone polymer or resin.

The present invention further relates to buoyant assemblies as disclosed in U.S. Pat. No. 4,897,303, issued Jan. 30, 1990 to F. P. McCullough et al. employing the fiber. A multiplicity of these fibers can form a batting or filling that has enhanced cohesiveness and in which the fibers form smaller interstitial spaces that provide the batting with improved buoyancy. In addition, the buoyant assembly is light weight and provides good thermal insulation, has a low water pick-up and is flame retardant In accordance with the procedure disclosed in U.S. Pat. No. 4,897,303, the fibers are coated with a water insoluble hydrophobic composition which can consist of any light weight, settable or curable composition that can be deposited as by spraying, dipping, and the like, so as to adhere to the fibers. Suitable compositions include high molecular weight waxes, haloaliphatic resins, thermoset and thermoplastic resins, ionomers, silicone products, polysiloxanes, and the like. Preferred coatings include polytetrafluoroethylene, polyvinylidene fluoride, polyvinyl chloride, etc. The buoyant assembly employing the fibers are particularly useful in articles such as fillers for personal apparel, e.g. jackets, sleeping bags, floatation equipment, and the like.

Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. It is intended that the specification and examples be considered exemplary only with the true scope and spirit of the invention indicated by the following claims. Furthermore, the term "comprising" includes the terms "consisting of" and "consisting essentially of," and the terms comprising, including, and containing are not intended to be limiting.

What is claimed is:

1. A non-electrically conductive biregional fiber comprising:

an inner core region of a partially oxidized thermoplastic polymeric composition; and a surrounding outer sheath region of a thermoset carbonaceous material;

wherein said fiber is ignition resistant and has an LOI (Limiting Oxygen Index) value of greater than 50%.

2. The fiber of claim 1, wherein the ratio (r:R) of the radius of the inner core region (r) with respect to the total radius of the fiber (R) is from 1:4 to 1:1.05.

3. The fiber of claim 1, wherein said carbonized outer sheath region has a density of from 1.9 to 2.0 g/cm$^3$.

4. The fiber of claim 3, having a surface area of from greater than 1 to 150 m$^2$/g, and a contiguous fiber surface that is substantially free of pits and pores, said surface having micropores representing less than 5% of the total surface area of the fiber.

5. The fiber of claim 1, wherein said fiber is flexible, has a bending strain value of from greater than 0.01% to less than 50%.

6. The fiber of claim 1, having a breaking twist angle of from 4 to 13 degrees.

7. The fiber of claim 1, wherein said fiber is crimped and has an elongatability to break of from 15% to 25%.

8. The fiber of claim 1, having a generally circular, non-circular, or tubular cross-sectional shape, and a diameter of from 1 to 30 micrometers.

9. The fiber of claim 1, having a coating of a water insoluble hydrophobic composition comprising a settable or curable composition selected from high molecular weight waxes, haloaliphatic resins, thermoset and thermoplastic resins, ionomers, silicone products, and polysiloxanes.

* * * * *